United States Patent [19]

Baldwin

[11] 4,209,410

[45] Jun. 24, 1980

[54] LUBRICANTS

[75] Inventor: Bernard A. Baldwin, Bartlesville, Okla.

[73] Assignee: Phillips Petroleum Company, Bartlesville, Okla.

[21] Appl. No.: 680,825

[22] Filed: Apr. 28, 1976

[51] Int. Cl.[2] ..... C10M 1/42

[52] U.S. Cl. ..... 252/48.2; 252/46.3

[58] Field of Search ..... 252/48.2, 46.3; 260/609 R

[56] References Cited

U.S. PATENT DOCUMENTS

| | | | |
|---|---|---|---|
| 2,561,780 | 7/1951 | Brooks | 252/48.2 |
| 2,563,586 | 8/1951 | Dazzi | 252/48.2 |
| 2,570,050 | 10/1951 | Eby | 252/48.2 |
| 2,776,997 | 1/1957 | Doumani | 260/609 R |
| 3,303,130 | 2/1967 | Scypinski et al. | 252/46.3 |
| 3,729,518 | 4/1973 | Lepper et al. | 252/48.2 |

*Primary Examiner*—Arthur P. Demers

[57] ABSTRACT

The addition of a small minor amount of at least one hydroxyalkyl sulfide to lubricating oils, greases, automatic transmission oils, cutting oils, hydraulic fluids, and the like improves the antiwear properties of the resulting compositions.

5 Claims, No Drawings

LUBRICANTS

This invention relates to improved lubricants and a process of preparing the same. In accordance with another aspect, this invention relates to hydroxyalkyl sulfide additive agents which impart to lubricants antiwear characteristics. In accordance with a further aspect, this invention relates to lubricating oils of improved antiwear properties having incorporated therein a small, but minor quantity of at least one hydroxyalkyl sulfide. In accordance with a still further aspect, this invention relates to hydroxyalkyl sulfide additives for lubricants that improve the antiwear properties of the resulting compositions.

Many lubricants, such as lubricating motor oil, require efficient antiwear additives to prevent or reduce scuffing or unreasonable wear caused by contact of moving metal parts. Indeed, such antiwear additives are essential for the satisfactory lubrication of modern high-compression internal combustion engines.

For many years, a particularly effective antiwear agent, zinc dialkyldithiophosphate (ZDTP), has been widely used. Despite the fact that this additive has been very effective and very successful in a number of lubricating motor oils, it is presently considered desirable to replace this additive with another. The advent of catalytic exhaust converters on the automobile scene has precluded the use of lead compounds or other similar materials in gasolines in order to prevent premature fouling of the catalysts. Therefore, the elimination of heavy metal compounds such as zinc compounds from motor oils is also under strong consideration in order to avoid the migration of such substances through the combustion chamber and into the catalytic zone. Consequently, a substantial effort has been made to find a replacement for ZDTP which would not only be as effective as that agent, but which would also be free of zinc and phosphorus.

The present invention now provides an antiwear additive which is not only at least as effective as ZDTP, but which contains only the element sulfur in addition to the elements of carbon, hydrogen, and oxygen. Sulfur is generally considered an element which can be tolerated by catalytic exhaust systems.

Accordingly, an object of this invention is to provide ashless additives for lubricants.

Another object of this invention is to provide improved additives exhibiting antiwear properties in lubricants.

Another object of this invention is to provide improved lubricating compositions utilizing the additives of the invention.

Other objects, aspects, and the several advantages of the invention will be apparent to those skilled in the art upon a study of the specification and the appended claims.

In accordance with this invention, the antiwear properties of a lubricating composition are improved by incorporating therein a minor amount of at least one hydroxyalkyl sulfide.

Hydroxyalkyl sulfides which can be employed in this invention can be represented by the formula RSR'OH, where R is a hydrocarbyl radical selected from the group consisting of alkyl, cycloalkyl, and aryl, and combinations thereof such as alkaryl, aralkyl, and the like, said hydrocarbyl radical having about 6 to about 30 carbon atoms, and R' is an alkylene radical having 1 to about 6, preferably 2 to 4, carbon atoms.

Examples of some hydroxyalkyl sulfides which can be used in this invention are hexylthiomethanol, 2-(hexylthio)ethanol, 3-(octylthio)-1-propanol, 1-(decylthio)-2-propanol, 2-(dodecylthio)ethanol, 3-(dodecylthio)-1-propanol, 2-methyl-4-(2-methyltetradecylthio)-1-butanol, 5-(eicosylthio)-2-pentanol, 4-(triacontylthio)-1-butanol, 6-(triacontylthio)-1-hexanol, 2-(cyclohexylthio)ethanol, 3-(3-methylcyclooctylthio)-1-propanol, 4-(cyclopentylmethylthio)-2-pentanol, 2-(phenylthio)ethanol, 3-(p-tolylthio)-1-propanol, 4-(benzylthio)-1-butanol, and the like, and mixtures thereof.

The lubricant composition into which the present antiwear additive can be formulated can be any such lubricating compostion in which antiwear or antiscuffing protection is desirable. Thus, such compositions can include motor oils, greases, automatic transmission oils, cutting oils, hydraulic fluids, and other lubricating compositions comprising mineral oil.

These lubricating compositions are based on mineral oils such as those of petroleum origin and are preferably refined mineral oils produced by well-known refining processes employing techniques such as hydrogenation, polymerization, dewaxing, solvent extraction, etc. These oils generally have a Saybolt viscosity at 100° F. (38° C.) in the range of about 60 to about 5,000 SUS and a Saybolt viscosity at 210° F. (99° C.) of from about 30° to about 250 SUS. The mineral oils can be paraffinic, naphthenic, or aromatic, or mixtures of these.

When such lubricants are in the form of a grease, the lubricant composition will contain a suitable grease thickener such as a lithium soap or a hydrocarbon polymer. Such grease compositions are well known in the art, and they are generally prepared by dissolving soaps and/or polymers in the oil at elevated temperatures.

The amount of hydroxyalkyl sulfide antiwear additive in the lubricating composition can vary, depending in part on the nature of the lubricant and the specific lubricating application, but generally will be within the range of from about 0.02 to about 4, preferably from about 0.1 to about 2, percent by weight of the total lubricating composition.

In addition to the antiwear additive, the lubricating composition can contain other conventional components such as antioxidants, viscosity index improvers, pour point depressants, antifoam agents, anticorrosion agents, and the like.

EXAMPLE I 2-(Dodecylthio)ethanol and 3-(dodecylthio)-1-propanol, two additives within the scope of this invention, were each evaluated as antiwear additives in heavy white mineral oil of 264 SUS at 100° F. (38° C.), the evaluations being by the Falex method using a modified ASTM D 2670-67 procedure. For the purpose of comparison, also evaluated by the same test procedure were (1) the white mineral oil with no additive, (2) the white mineral oil containing dodecyl propyl sulfide, an unsubstituted sulfide structurally related to the hydroxyalkyl sulfide additives of this invention, particularly to 3-(dodecylthio)-1-propanol, and (3) the white mineral oil containing the commercial ZDTP antiwear additive.

The wear tests were carried out using the well-known Falex test machine in accordance with a slight modification of the ASTM D 2670-67 procedure. In the procedure used, a rotating steel pin, 0.635 cm (25 in) in diameter was rotated at 290 rpm between two "V" steel blocks for one-half hour of break-in at an applied load of 23 kg (50 lb) followed by three hours of additional testing at 113 kg (250 lb) applied load. During this time, the rotating pin and "V" blocks were submerged in 60 g of the test oil. During the break-in period, the oil, pin, and "V" blocks were heated to 79.5° C. (175° F.). However, the temperature was not controlled during the test period but was allowed to increase or decrease depending upon the amount of frictional heat produced during the tests. The wear was measured by the number of radial degrees or teeth which a ratchet wheel pressure loader must be advanced to maintain a constant pressure during the course of the test. A lubricant composition with good antiwear properties would result in a wear equivalent to a relatively few teeth (less than 30) whereas a lubricating composition with poor antiwear properties would require the wheel to be turned through many teeth (more than 50).

The results are summarized in Table I. Each valve for wear represents the average of at least two tests.

TABLE I

| Additive | Additive Level, Wt. % Total wt. Basis[a] | Additive Level, Wt. % Sulfur Basis[b] | Wear, Number of Teeth |
|---|---|---|---|
| None | 0 | 0 | >100[c] |
| Dodecyl propyl sulfide | 1.61 | 0.21 | >100[c] |
| ZDTP | 1.00 | 0.20 | 22 |
| 2-(Dodecylthio)ethanol | 1.54 | 0.20 | 5 |
| 2-(Dodecylthio)ethanol | 0.15 | 0.02 | 17 |
| 3-(Dodecylthio)-1-propanol | 1.68 | 0.20 | 21 |

[a]Weight percent additive, based on total weight of mineral oil plus additive.
[b]Weight percent combined sulfur, based on total weight of mineral oil plus additive.
[c]Excessive wear led to catastrophic failure.

As shown in Table I, the mineral oil composition in the absence of any antiwear additive, or with dodecyl propyl sulfide as an additive, resulted in a very high degree of wear. In contrast, when ZDTP, 2-(dodecylthio)ethanol, or 3-(dodecylthio)-1-propanol was used at a level such as to provide nearly the same amount of combined sulfur in the mineral oil lubricant as was provided by the use of the dodecyl propyl sulfide, the lubricant composition exhibited good antiwear properties, the effectiveness of the 3-(dodecylthio)-1-propanol being at least as great as that of the ZDTP and the efffectiveness of the 2-(dodecylthio)ethanol being much greater than that of the ZDTP. In fact, the 2-(dodecylthio)ethanol was more effective than the ZDTP as an antiwear additive even when used in an amount such as to provide only one-tenth as much combined sulfur as was provided by the ZDTP.

I claim:

1. An improved lubricating composition comprising a major amount of a lubricating oil having incorporated therein a small amount, sufficient to improve the antiwear characteristics of the oil, of 2-(dodecylthio)ethanol or 3-(dodecylthio)-1-propanol.

2. A composition according to claim 1 wherein the amount of said sulfide present ranges from about 0.02 to about 4 percent by weight of the total lubricating composition.

3. A composition according to claim 1 wherein the lubricating oil has a Saybolt viscosity at 210° F. (99° C.) of from 30 to about 250 SUS and the amount of said sulfide present ranges from about 0.02 to about 4 percent by weight of the total lubricating composition.

4. A composition according to claim 1 wherein said sulfide is 2-(dodecylthio)ethanol which is present in an amount ranging from about 0.02 to about 4 percent by weight of the total lubricating composition and said lubricating oil has a Saybolt viscosity at 210° F. (99° C.) of from 30 to about 250 SUS.

5. A composition according to claim 1 wherein said sulfide is 3-(dodecylthio)-1-propanol which is present in an amount ranging from about 0.02 to about 4 percent by weight of the total lubricating composition and said lubricating oil has a Saybolt viscosity at 210° F. (99° C.) of from 30 to about 250 SUS.

* * * * *